US010235917B2

(12) United States Patent
Jung et al.

(10) Patent No.: US 10,235,917 B2
(45) Date of Patent: Mar. 19, 2019

(54) DISPLAY DEVICE AND METHOD OF DRIVING THE SAME

(71) Applicant: LG Display Co., Ltd., Seoul (KR)

(72) Inventors: Jeahun Jung, Daegu (KR); Euncheol Eom, Jeollabuk-do (KR); Subin Park, Jeollabuk-do (KR)

(73) Assignee: LG Display Co., Ltd., Seoul (KR)

( * ) Notice: Subject to any disclaimer, the term of this patent is extended or adjusted under 35 U.S.C. 154(b) by 406 days.

(21) Appl. No.: 14/979,983

(22) Filed: Dec. 28, 2015

(65) Prior Publication Data

US 2016/0189601 A1 Jun. 30, 2016

(30) Foreign Application Priority Data

Dec. 26, 2014 (KR) ..... 10-2014-0191143

(51) Int. Cl.
*G09G 3/20* (2006.01)

(52) U.S. Cl.
CPC ..... *G09G 3/20* (2013.01); *G09G 2310/027* (2013.01); *G09G 2310/0232* (2013.01); *G09G 2310/0291* (2013.01); *G09G 2330/021* (2013.01); *G09G 2360/16* (2013.01); *G09G 2360/18* (2013.01)

(58) Field of Classification Search
CPC ..... G09G 3/20; G09G 3/2092; G09G 3/2085; G09G 5/38; G09G 5/42
USPC ..... 345/204
See application file for complete search history.

(56) References Cited

U.S. PATENT DOCUMENTS

| | | | | |
|---|---|---|---|---|
| 6,232,945 | B1 * | 5/2001 | Moriyama | G09G 3/3648 345/100 |
| 6,801,180 | B2 | 10/2004 | Matsueda | |
| 7,002,568 | B2 | 2/2006 | Morita | |
| 7,859,525 | B2 | 12/2010 | Takatori et al. | |
| 8,830,155 | B2 | 9/2014 | Hsu et al. | |
| 2002/0158855 | A1 | 10/2002 | Matsueda | |
| 2002/0190973 | A1 | 12/2002 | Morita | |
| 2005/0083356 | A1 | 4/2005 | Roh et al. | |

(Continued)

FOREIGN PATENT DOCUMENTS

| | | | |
|---|---|---|---|
| CN | 1381030 | A | 11/2002 |
| CN | 1388510 | A | 1/2003 |

(Continued)

OTHER PUBLICATIONS

Chinese Office Action, dated Sep. 11, 2018, for the counterpart Chinese patent application No. 201511001337.5.

(Continued)

*Primary Examiner* — Carolyn R Edwards
(74) *Attorney, Agent, or Firm* — Morgan, Lewis & Bockius LLP

(57) ABSTRACT

A disclosed display device includes a data driver configured to receive data signals corresponding to an input image and to output a first data signal corresponding to a first portion of the input image to be displayed. The display device also includes a display panel having a plurality of data lines and a display area configured to display the first portion of the input image based on the first data signal from the data driver. The data driver is further configured to cut off a second data signal corresponding to a second portion of the input image substantially outside the display area of the display panel from being output.

20 Claims, 6 Drawing Sheets

(56) References Cited

U.S. PATENT DOCUMENTS

| | | | | |
|---|---|---|---|---|
| 2007/0205976 | A1 | 9/2007 | Takatori et al. | |
| 2011/0102471 | A1 | 5/2011 | Hsu et al. | |
| 2013/0257917 | A1* | 10/2013 | Peng | G09G 3/20 345/690 |

FOREIGN PATENT DOCUMENTS

| | | | |
|---|---|---|---|
| CN | 101034218 | A | 9/2007 |
| CN | 101826316 | A | 9/2010 |
| CN | 101847390 | A | 9/2010 |

OTHER PUBLICATIONS

Chinese Office Action, dated Mar. 5, 2018, for the counterpart Chinese patent application No. 2015-11001337.5.

* cited by examiner

DISPLAY DEVICE AND METHOD OF DRIVING THE SAME

This application claims the benefit of Korean Patent Application No. 10-2014-0191143, filed on Dec. 26, 2014, which is incorporated herein by reference for all purposes as if fully set forth herein.

BACKGROUND OF THE INVENTION

Field of the Invention

The present invention relates to a display device and a method of driving the same, and more particularly to, a display device and a method of driving the same that are capable of reducing power consumption.

Discussion of the Related Art

As the information technology has advanced, the market of display devices as mediums connecting users and information has grown. In line with this, the use of display devices, such as liquid crystal displays (LCDs), organic light emitting display devices, electrophoretic displays (EPDs), and plasma display panels (PDPs), has increased.

Some of the aforementioned display devices, for example, an LCD device or an organic light emitting display device, include a display panel having a plurality of subpixels disposed in a matrix form and a driver to drive the display panel. The driver includes a scan driver to supply a scan signal (or a gate signal) to the display panel and a data driver to supply data signals to the display panel. In these display devices, when the display panel emits light or allows light to be transmitted therethrough on the basis of the power output from a power supply unit, and a scan signal and data signals respectively output from the scan driver and the data driver, a specific image is displayed.

The aforementioned display devices may be implemented as free form display panels having a circular or oval shape, as well as a quadrangular shape. The free form display panel is mainly applied to and used in wearable display devices (watches or glasses) for which low power consumption is a goal.

However, in a related art display device, data signals are output from all the channels of the data driver regardless of a shape of the display panel. Also, in the related art display device, a source amplifier of the data driver is driven regardless of a shape of the display panel. As a result, the related art display device is in need of improvement in its ability to reduce power consumption.

SUMMARY

Accordingly, the present invention is directed to a display device and a method of driving the same that substantially obviate one or more of the problems due to limitations and disadvantages of the related art.

An object of the present invention is to reduce power consumption of a data driver and a display device incorporating a data driver by interrupting a portion of a source amplifier in a skip (floating) or OFF (blanking) manner.

Another aspect of the present invention is to reduce power consumption by a data driver, and thus by a display device incorporating a data driver, by cutting off from being output a data signal corresponding to an area of the input image not displayed to a user in various types of display panels, such as a free form display panel or a window image display.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a display device comprises: a display panel having a plurality of data lines and a display area configured to display a first portion of an input image; a source amplifier having a plurality of amplifiers, and configured to receive a first data signal corresponding to the first portion of the input image and a second data signal corresponding to a second portion of the input image outside the display area, to amplify and output the first data signal, and to cut off the second data signal from being output; and a source amplifier control circuit configured to control the source amplifier to output the amplified first data signal and to cut off the second data signal from being output, wherein the display panel is configured to display the first portion of the input image based on the amplified first data signal.

In another aspect, a display device comprises: a data driver configured to receive data signals corresponding to an input image and to output a first data signal corresponding to a first portion of the input image to be displayed; and a display panel having a plurality of data lines and a display area configured to display the first portion of the input image based on the first data signal from the data driver, wherein the data driver is further configured to cut off a second data signal corresponding to a second portion of the input image substantially outside the display area of the display panel from being output.

In yet another aspect, a method of driving a display device having a display panel comprises: receiving and analyzing data signals corresponding to an input image; calculating a display area in the input image to be displayed on the display panel based on the data signals; generating an output cutoff signal to cut off a first group of the data signals corresponding to a portion of the input image outside the display area; and outputting the data signals and the output cutoff signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate example embodiments of the invention and together with the description serve to explain the principles of the invention. In the drawings.

DETAILED DESCRIPTION OF EXAMPLE EMBODIMENTS

Reference will now be made in detail to embodiments of the present invention, examples of which are illustrated in the accompanying drawings. The example embodiments will be described with reference to the accompanying drawings.

A display device according to example embodiments may be implemented as a navigation device, a video player, a personal computer (PC), a wearable device (a watch or glasses), a mobile phone (smartphone), or any other device with a display capability. For a display panel of the display device according to the example embodiments, a liquid crystal display panel, an organic light emitting display panel, an electrophoretic display panel, or a plasma display panel may be implemented, but the present invention is not limited to such display panels and may implement other types of display panels. In the below example embodiments, a display device implementing an organic light emitting display panel is described in detail as an example.

Figure 1:
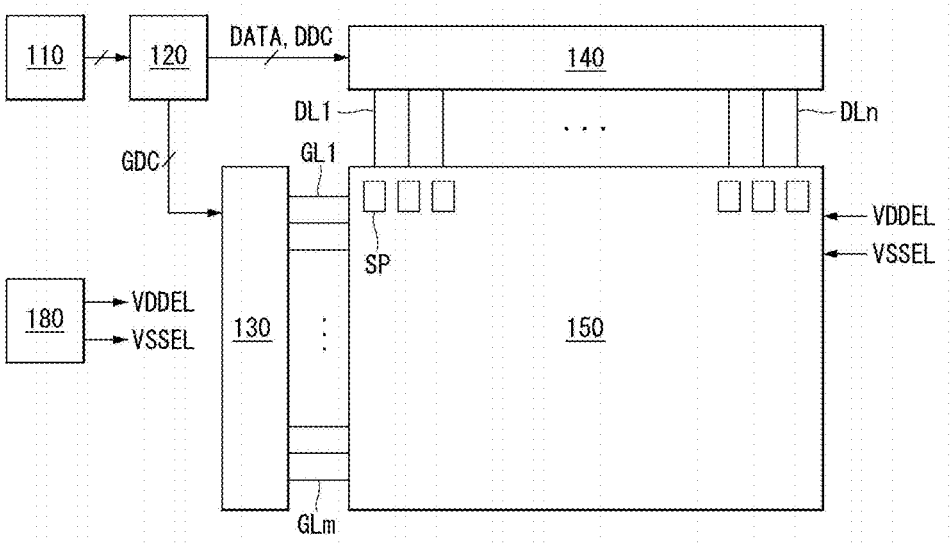
FIG. 1 is a block diagram schematically illustrating an organic light emitting display device according to an example embodiment of the present invention.
Figure 2:
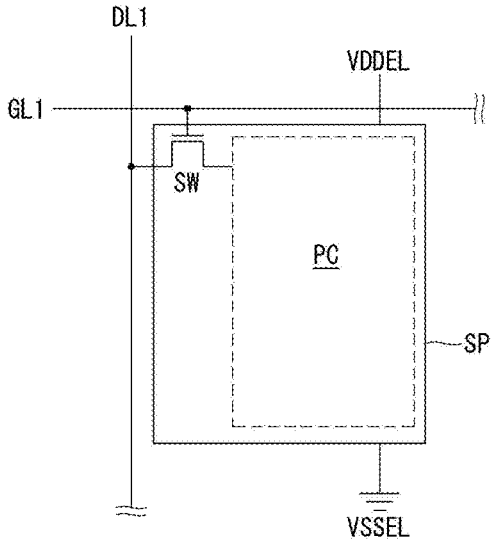
FIG. 2 is a view schematically illustrating an example configuration of a subpixel illustrated in FIG. 1.

FIG. 1 is a block diagram schematically illustrating an organic light emitting display device according to an example embodiment, and FIG. 2 is a view schematically illustrating an example configuration of a subpixel SP illustrated in FIG. 1.

As illustrated in FIG. 1, an organic light emitting display device according to an example embodiment includes an image supply circuit 110, a timing controller 120, a scan driver 130, a data driver 140, a display panel 150, and a power supply circuit 180. The display panel 150 displays an image based on a scan signal and data signals DATA output respectively from a scan driver 130 and a data driver 140, which collectively may compose a driver of the display device. The display panel 150 may employ a top emission scheme, a bottom-emission scheme, or a dual-emission scheme.

The display panel 150 may be implemented as a flat type, a curved type, or a flexible type panel according to the materials used for a substrate. In the display panel 150, subpixels SP positioned between two substrates are configured to emit light based on a driving current.

As illustrated in FIG. 2, for example, one subpixel SP may include a switching transistor SW connected to a scan line GL1 and a data line DL1 (or be formed at an intersection between the scan line GL1 and the data line DL1), and a pixel circuit PC configured to operate based on a data signal DATA supplied through the switching transistor SW. The pixel circuit PC may include such circuit elements as a driving transistor, a storage capacitor, and an organic light emitting diode (OLED), and a compensation circuit for performing compensation in relation to these circuit elements.

In this example configuration of the subpixel SP, when the driving transistor (not shown) is turned on in response to a data voltage stored in the storage capacitor (not shown), a driving current is supplied to the OLED (not shown) positioned between a first power line VDDEL and a second power line VSSEL. The OLED emits light in response to the driving current.

The compensation circuit is a circuit to compensate for a threshold voltage, or other characteristics, of the driving transistor. The compensation circuit may include one or more thin film transistors (TFTs) and a capacitor. A configuration of the compensation circuit may vary according to the particular compensation method implemented. A description of any specific example will be omitted since the application of the invention and the example embodiments is not limited to or is dependent on a particular compensation method. Also, the TFTs may be of any of the following types: low temperature polysilicon (LTPS), amorphous silicon (a-Si), an oxide, or an organic semiconductor layer.

The image supply circuit 110 is configured to processes input image data signals, and output the processed data signals together with a vertical synchronization signal, a horizontal synchronization signal, a data enable signal, and a clock signal. The image supply circuit 110 supplies the vertical synchronization signal, the horizontal synchronization signal, the data enable signal, the clock signal, and the data signals to the timing controller 120.

The timing controller 120 may receive the data signals, as well as such signals as the vertical synchronization signal, the horizontal synchronization signal, the data enable signal, and the clock signal, from the image supply circuit 110, and output a gate timing control signal GDC for controlling an operation timing of the scan driver 130 and a data timing control signal DDC for controlling an operation timing of the data driver 140. The timing controller 120 may supply the data signals DATA together with the data timing control signal DDC to the data driver 140.

The scan driver 130 may output a scan signal, while shifting a level of a gate voltage, in response to the gate timing control signal GDC supplied from the timing controller 120. The scan driver 130 may include a level shifter and a shift register. The scan driver 130 may supply a scan signal to the subpixels SP included in the display panel 150 through scan lines GL1 to GLm, where m is a natural number greater than 1. The scan driver 130 may be in a gate-in-panel format or in the form of an integrated circuit (IC), or in a combination of both. A portion of the scan driver 130 formed in the gate-in-panel format may be the shift register.

In response the data timing control signal DDC supplied from the timing controller 120, the data driver 140 may sample and latch the data signals DATA from the timing controller 120, convert the data signals in digital form into analog signals to correspond to respective gamma reference voltages, and output the converted analog signals. The data driver 140 may then supply the data signals in the form of analog voltages to the subpixels SP included in the display panel 150 through the data lines DL1 to DLn, where n is a natural number greater than 1. The data driver 140 may be in the form of an IC.

The power supply circuit 180 generates the first voltage VDDEL and the second voltage VSSEL to be supplied to the display panel 150. The first voltage VDDEL is a high potential voltage, and the second voltage VSSEL is a low potential voltage. The power supply circuit 180 may generate power to be supplied to the scan driver 130 or the data driver 140, as well as the voltages VDDEL and VSSEL to be supplied to the display panel 150, on the basis of an input power received from an external source.

The display device according to the example embodiment described above displays a specific image as the display panel 150 emits light on the basis of the first and second voltages VDDEL and VSSEL output from the power supply circuit 180, and the scan signal and the data signals DATA respectively output from the scan driver 130 and the data driver 140.

The display panel 150 described above may be implemented as a free form display panel having a circular or oval shape. Such a free form display panel is mainly applied to and used in a wearable display device (e.g., a watch or glasses) for which low power consumption is a desirable feature. Example embodiments of the invention are described below along with potential problems of a circular display panel as an example of a free from panel.

Figure 3:
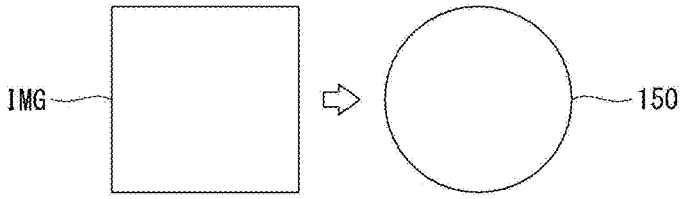
FIG. 3 is a view illustrating an example image supplied to a free form display panel and a circular display panel.
Figure 4:
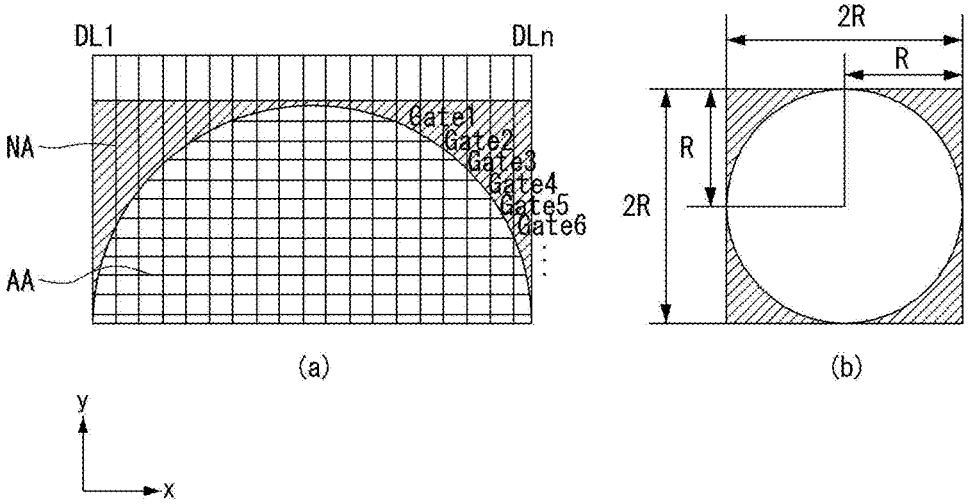
FIG. 4 is a view schematically illustrating rates of loss when data signals are generally supplied to an example free form display panel.

FIG. 3 is a view illustrating an example image supplied to a free form display panel and a circular display panel. FIG. 4 is a view schematically illustrating rates of loss, for example, when data signals are generally supplied to a free form display panel.

As illustrated in FIGS. 3 and 4, an image IMG configured to have the same shape as that of the related art quadrangular display panel is supplied to a circular display panel 150 and displayed thereon. As illustrated in part (a) of FIG. 4, scan lines are disposed along the X axis and data lines are disposed along the Y axis.

An image is not displayed in a non-display area NA, which is the area outside a display area AA having a circular shape. Here, the data driver used in the related art display device drives all output channels and outputs data signals to all of the data lines for each scan line, regardless of a shape of the display panel. Accordingly, the area positioned outside of the circular display area AA is a loss area for which power is unnecessarily consumed.

For example, a loss rate of data lost in the circular display panel as illustrated in part (a) of FIG. 4 may be calculated as shown in part (b) of FIG. 4. When a radius of the circular display panel is R and the number of original data signals per frame is $2R \times 2R = 4R^2$, a data loss rate is $4R^2 - (\pi * R^2)$, which is approximately $0.86R^2$ or approximately 21.5% of $4R^2$. In other words, if the data driver drives a circular display panel in the same manner that it drives a quadrangular display panel, some of the power is unnecessarily consumed due to the data loss of about 21.5% per frame.

As described above, in the related art display device, data signals are output from all of the output channels of the data driver for each scan line, regardless of the shape of the display panel. Also, in the related art display device, a source amplifier is driven for each output channel of the data driver for each scan pulse, regardless of the shape of the display panel.

First Embodiment

Figure 5:
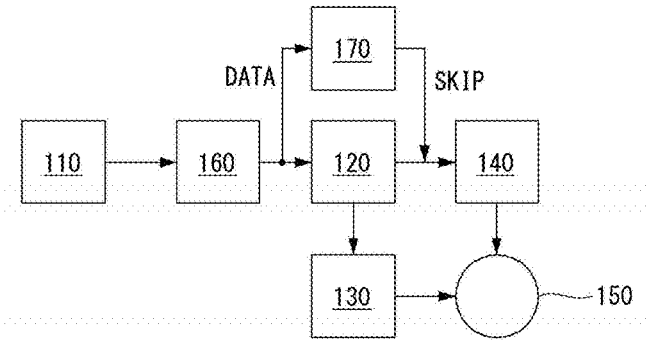
FIG. 5 is a block diagram schematically illustrating a display device according to a first example embodiment of the present invention.
Figure 6:
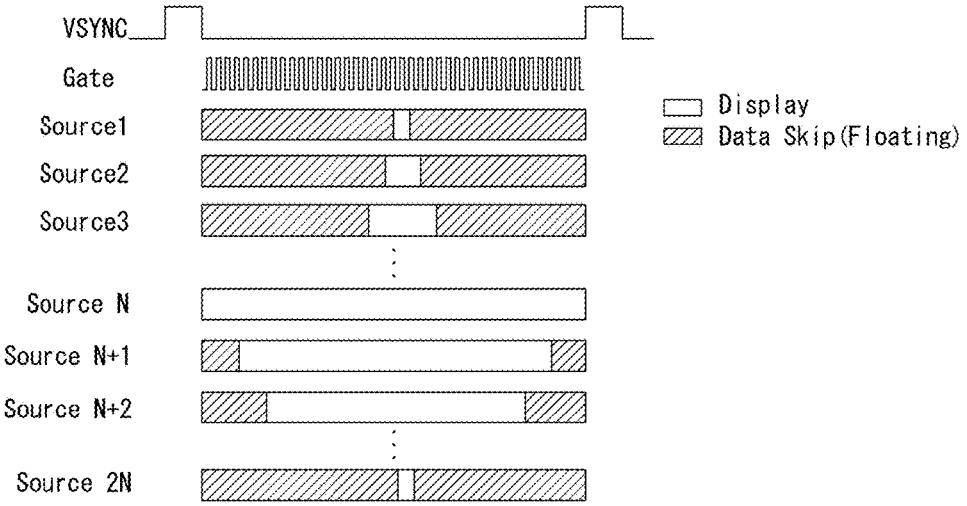
FIG. 6 is a waveform view illustrating an output state of a data driver according to the first example embodiment.

FIG. 5 is a block diagram schematically illustrating a display device according to a first example embodiment of the present invention. FIG. 6 is a waveform illustrating an output state of a data driver according to the first example embodiment. In FIG. 6, VSNC denotes a vertical synchronization signal, Gate denotes a scan signal, Source 1 to Source 2N denote data signals output from output channels of the data driver 140. N may be a natural number greater than 1.

As illustrated in FIGS. 5 and 6, the display device according to the first example embodiment includes an image supply circuit 110, a memory 160, a timing controller 120, a scan driver 130, a data driver 140, a display panel 150, and a display area control circuit 170.

The memory 160 serves to temporarily store a frame data representing a frame of the input image transmitted from the image supply circuit 110. The memory 160 may be configured as a static random access memory (SRAM), for example. However, other types of memory may be used, and this example embodiment is not limited to implementing an SRAM.

The display area control circuit 170 retrieves the frame data from the memory 160 and analyzes the retrieved frame data to calculate a display area to be substantially displayed on the display panel 150. In order to calculate the display area, the display area control circuit 170 may perform edge detection on the frame data. However, this embodiment is not limed to implementing edge detection.

The display area control circuit 170 is configured to calculate the display area and generate an output skip signal SKIP for controlling the data driver 140 to skip outputting (i.e., mask or not transmit) data signals directed to those data lines which does not correspond to the display area for a given scan line. The output skip signal SKIP generated by the display area control circuit 170 is transferred to the data driver 140.

The timing controller 120 and the data driver 140 may respectively provide and receive data in a data communication format. Thus, the output skip signal SKIP generated by the display area control circuit 170 may be transferred together with data signals, among others, to the data driver 140 in a data communication format.

The data driver 140 converts digital data signals into analog data signals on the basis of the digital data signals and various timing control signals supplied from the timing controller 120. The data driver 140 also receives the output skip signal SKIP generated by the display area control circuit 170, in addition to the digital data signals.

Thus, data signals for a portion which corresponds to the display area for a given scan line are normally output, while data signals for a portion which does not correspond to the display area for the given scan line are skipped (or floated) and not output. For ease of reference, the former may be referred to below as the first data signals, and the latter the second data signals. As a result, for a given scan line, the data driver 140 may have an output channel normally outputting a first data signal and another output channel not outputting a second data signal but skipping (or floating) it. A given output channel may normally output the first data signals for some of the scan lines but skip outputting the second data signals for the other scan lines. In this case, the amplifiers and any other elements in the data driver 140 for amplifying the data signals and outputting the amplified data signals may be skipped (or not used) for those output channels not corresponding to the display area. Thus, power consumption may be reduced.

For example, with reference to a first source output channel Source1 of the data driver 140, no data signal is output for a number of scan lines or scan pulses until a data signal is output for one or a small number of scan lines about halfway through a frame cycle. Then, no data signal is output to the first source output channel Source1 again for the remainder of the frame cycle. This is because the first source output channel (Source1) of the data driver 140 corresponds to the first data line or the first group of data lines (an area corresponding to an outer portion) of the display panel 150. Thus, an amount of data output to that output channel is small compared to the other output channels.

As another example, with reference to an N-th source output channel (Source N) of the data driver 140, a data signal is output for each of the scan lines in the frame cycle. This is because the N-th source output channel (Source N) of the data driver 140 corresponds to the N-th data line or the N-th group of data lines (an area corresponding to a central portion) of the circular display panel 150. Thus, an amount of data output to that output channel is the largest among all the output channels.

As yet another example, with reference to the (N+2)-th source output channel (Source N+2) of the data driver 140, no data signal is output for the first few scan lines in a given frame cycle. Then, a data signal is output to the channel for each scan line thereafter in the given frame cycle until the last few scan lines, at which point no data is output again. This is because the (N+2)-th source output channel (Source N+2) of the data driver 140 corresponds to the (N+2)-th data line or group of data lines (an area near the central portion) of the circular display panel 150. Thus, an amount of data output to that output channel is larger than most of the other output channels.

In the above description, to assist with the understanding of various embodiments of the present invention, an embodiment in which the data driver is controlled such that it does not output data signals with respect to an area outside the display area of a circular display panel is discussed as an example. However, it is an illustrative example, and the present invention may also be applied to various different types and shapes of display devices, including, for example, a display device in which only a portion of a screen is displayed for a special purpose, and those incorporating a free form display panel, such as a circular or oval display panel or a display panel having an irregular shape.

As described above, in the first example embodiment, power consumption is reduced by outputting data signals only for a portion of the input image data to be displayed on the display panel and skipping or not transmitting data signals for the remaining portion of the input image data. To this end, in the first example embodiment, when input digital data signals are transferred to the data driver, the conversion of the digital data signals into an analog data signals may also be skipped or not performed for the data signals corresponding to the non-display area. Also, in the first example embodiment, the digital data signals corresponding to the non-display area may be converted to an analog data signal, but the transfer of the analog data signals to the source amplifier may be skipped. In other words, the converted analog data signals for the non-display area may be kept from being transmitted to the source amplifier.

Data skipping for not outputting data signals corresponds to a portion of the input image that is not displayed in a display area. Thus, data skipping may be performed on a channel by channel basis or on a block by block basis in the data driver 140, where a block may include two or more channels.

Second Embodiment

Figure 7:
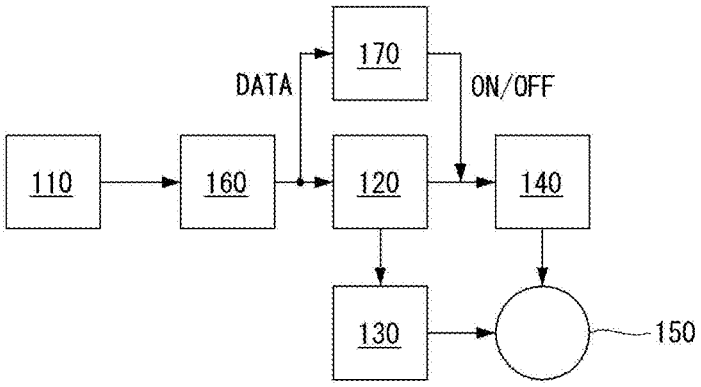
FIG. 7 is a block diagram schematically illustrating a display device according to a second example embodiment of the present invention.
Figure 8:
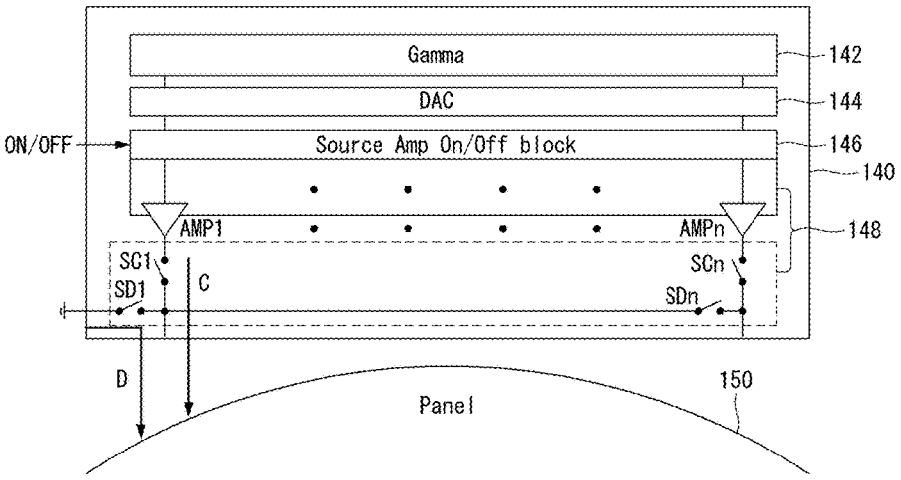
FIG. 8 is a block diagram schematically illustrating an example internal configuration of a data driver according to the second example embodiment.
Figure 9:
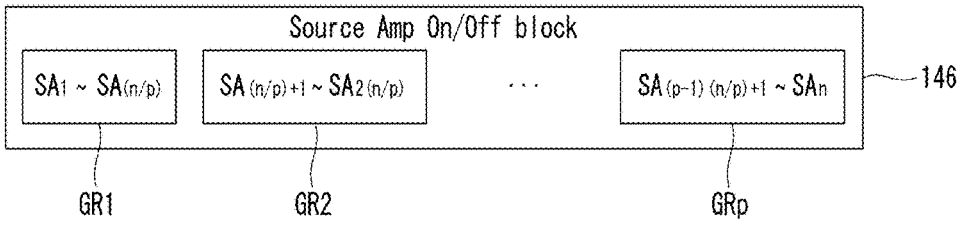
FIG. 9 is a block diagram schematically illustrating an example of a source amplifier control unit of FIG. 8.
Figure 10:
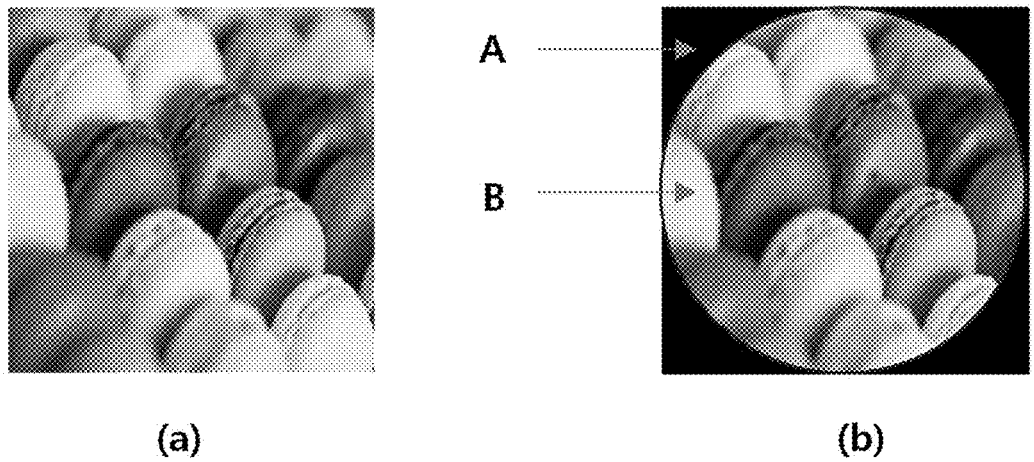
FIG. 10 is a view illustrating a change between input data signals representing an input image and output data signals of the data driver according to the second example embodiment.

FIG. 7 is a block diagram schematically illustrating a display device according to a second example embodiment of the present invention. FIG. 8 is a block diagram schematically illustrating an internal configuration of a data driver according to the second example embodiment. FIG. 9 is a block diagram schematically illustrating an example of a source amplifier control unit of FIG. 8. FIG. 10 is a view illustrating a change between input data signals representing an input image and output data signals of the data driver according to the second example embodiment.

As illustrated in FIG. 7, the display device according to the second example embodiment includes an image supply circuit 110, a memory 160, a timing controller 120, a scan driver 130, a data driver 140, a display panel 150, and a display area control circuit 170.

The memory 160 serves to temporarily store a frame data representing a frame of an input image transmitted from the image supply circuit 110. The memory 160 may be configured as a static random access memory (SRAM), for example. However, other types of memory may be used, and this example embodiment is not limited to implementing an SRAM.

The display area control circuit 170 retrieves the frame data from the memory 160 and analyzes the retrieved frame data to calculate a display area to be substantially displayed on the display panel 150. In order to calculate the display area, the display area control circuit 170 may perform edge detection on the frame data. However, this embodiment is not limed to implementing edge detection.

The display area control circuit 170 calculates the display area, and generates an output on/off signal ON/OFF for controlling the data driver 140 to turn on the output for a portion corresponding to the display area or controlling the data driver 140 to turn off the output (e.g., by turning off the source amplifier) for a portion not corresponding to the display area. The output on/off signal ON/OFF generated by the display area control circuit 170 is transferred to the data driver 140.

The timing controller 120 and the data driver 140 may respectively provide and receive data in a data communication format. Thus, the output on/off signal ON/OFF generated by the display area control circuit 170 may be transferred together with data signals, among others, to the data driver 140 in a data communication format.

The data driver 140 converts digital data signals into analog data signals on the basis of the digital data signals and various timing control signals supplied from the timing controller 120. The data driver 140 also receives the output on/off signal ON/OFF generated by the display area control circuit 170, in addition to the digital data signals.

Thus, data signals for a portion corresponding to the display area for a given scan line (i.e., the first data signals) is normally output, while data signals for a portion not corresponding to the display area for the given scan line (i.e., the second data signals) is not output by turning off the related portion of the source amplifier based on the OFF signal. As a result, for a given scan line, the data driver 140 may have an output channel normally outputting a first data signal and another output channel not outputting a second data signal. A given output channel may normally output the first data signals for some of the scan lines but skip outputting the second data signals for the other scan lines. In this case, the amplifiers and any other elements in the data driver 140 for amplifying the data signals for a non-display area and outputting such amplified data signal are not used (or turned off) in the data driver 140. Thus, power consumption may be reduced.

As illustrated in FIGS. 8 and 9, the data driver 140 may include a gamma circuit (or a "Gamma") 142, a digital-to-analog conversion circuit (or a "DAC") 144, a source amplifier control circuit (or a "Source Amp On/Off block") 146, and a source amplifier 148 including amplifiers AMP1 to AMPn, where n is a natural number greater than 1. Other circuit elements, such as a latch, that may also be included in the data driver 140 are not shown in the drawings.

The gamma circuit 142 serves to convert input digital data signals to correspond to respective gamma reference voltages. The digital-to-analog conversion circuit 144 serves to convert digital data signals corresponding to the respective gamma reference voltages into analog data signals.

The source amplifier control circuit 146 serves to control the source amplifier 148 in response to an output on/off signal ON/OFF supplied from the display area control circuit 170. The source amplifier 148 serves to amplify the analog data signals output from the digital-to-analog conversion circuit 144 and to output the amplified analog data signals. The amplified analog data signals output from the data driver 140 are supplied to the corresponding subpixels through the respective data lines in the display panel 150.

In response to the output on/off signal ON/OFF, the source amplifier control circuit 146 controls the amplifiers AMP1 to AMPn included in the source amplifier 148 individually (independent controlling) or in units of blocks (group controlling) to amplify and output the analog data signals, or to cut off the analog data signals from being output.

As illustrated in FIG. 9, the source amplifier control circuit 146 may set control blocks GR1 to GRn as units of blocks, and based on an output on/off signal ON/OFF, may activate (turn on) or deactivate (turn off) the amplifiers AMP1 to AMPn included in the source amplifier 148 in units of blocks (or groups). Thus, only some groups of the amplifiers AMP1 to AMPn may be activated (turned on) while the other groups are deactivated (turned off).

For example, in a case in which an image like (a) of FIG. 10 is received as an input image, an image like (b) of FIG. 10 may be output. Here, the data driver 140 may operate as described below.

The display area control circuit 170 generates an output off signal OFF with respect to an area A corresponding to a non-display area, generates an output on signal ON with respect to an area B corresponding to the display area, and outputs the generated OFF and ON signals. The source amplifier control circuit 146 controls the amplifiers AMP1 to AMPn included in the source amplifier 148 in response to the output on/off signal ON/OFF.

As a result, the amplifiers are deactivated with respect to the area A corresponding to the non-display area by the output OFF signal. Here, the area A corresponding to the non-display area may receive a black voltage output along an OFF path D in response to an operation of an output OFF switch SD1. The black voltage may be set to a voltage corresponding to a ground voltage GND (or to the second voltage or the low potential voltage).

In contrast, the amplifiers are activated with respect to the area B corresponding to the display area. Here, the area B corresponding to the display area receives data signals output, for example, along an ON path C in response to an operation of an output ON switch SC1. In other words, according to the aforementioned driving scheme, the area A is blanked out and only the area B actually receives data signals.

The output OFF switch SD1 and the output ON switch SC1 may be disposed at the output of the source amplifier 148 between the amplifier AMP1 and an output terminal of the source amplifier 148 (or an input terminal of an output buffer if an output buffer is employed in the data driver 140). The output OFF switch SD1 and the output ON switch SC1 are included in the source amplifier 148, for example, but may also be considered as separate components.

The output OFF switch SD1 may have a switch electrode connected to a signal line of the source amplifier control circuit 146, a first electrode connected to the ground voltage, and a second electrode connected to an output line for providing a data signal to a corresponding data line. The output ON switch SC1 may have a switch electrode connected to a signal line of the source amplifier control unit 146, a first electrode connected to an output terminal of the source amplifier 148, and a second electrode connected to an output line for proving a data signal to a corresponding data line.

The control method using the output OFF switch SD1 and the output ON switch SC1 as described about is an example of this embodiment. The source amplifier control unit 146 may also control the amplifiers AMP1 to AMPn included in the source amplifier 148 to be turned on or off.

FIG. 9 illustrates an example in which a first control block GR1 is set to $SA_1$ to $SA_{(n/p)}$, a second control block GR2 is set to $SA_{(n/p)+1}$ to $SA_{2(n/p)}$, and so on to the p-th control block GRp set to $SA_{(p-1)(n/p)+1}$ to $SA_n$, where "p" is a natural number greater than 1 but smaller than "n". However, this is an illustrative example, and the control blocks may be variably set to correspond to the non-display area of an image, instead of being fixed.

The number of the control blocks may be fixed or variably set. A reason for varying blocks included in a control block or changing the number of blocks included in a control block is because display panels may have various shapes, such as an oval or circular shape. Another reason is that the non-display area itself may vary for a given display panel. For example, in a smartphone with a quick cover having a window, data signals for an area outside a window area visible to a user may be deactivated when the quick cover covers the phone, while the data signals for the same area may be activated when the phone is uncovered and the entire display screen is visible to the user. Moreover, in displaying images in various shapes, such as those displayed in a free form display panel or a window image display, the non-display area may vary in the event that data signals with respect to an area not shown to the user is to be cut off from being output.

Power consumption of the data driver is dependent upon a static and/or dynamic current. The second example embodiment employs the foregoing example configuration and driving scheme to reduce power consumption with respect to static and dynamic currents. An experiment result obtained by comparing the second example embodiment with the related art device shows that, compared to the related art device, the second example embodiment has an effect of reducing power consumption by about 21.5% based on the non-use or a partial use of a source amplifier.

Third Embodiment

Figure 11:
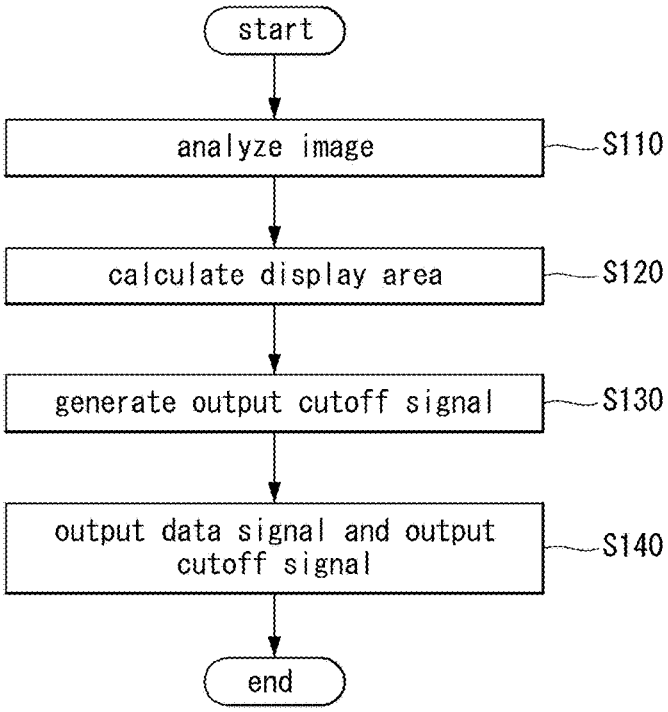
FIG. 11 is a flow chart illustrating a method for driving a display device according to a third example embodiment of the present invention.

Hereinafter, a method for driving a display device according to a third example embodiment of the present invention is described. FIG. 11 is a flow chart illustrating a method for driving a display device according to a third example embodiment.

As illustrated in FIGS. 5, 7, and 11, a method for driving a display device according to the third example embodiment may include steps from analyzing an input image (S110) to displaying an image (S140), which may be sequentially performed.

First, an input image supplied from an external source is analyzed (S110). In analyzing the input image, a frame data is retrieved from the memory 160 and analyzed.

Next, a display area is calculated (S120). In calculating a display area, a display area of the frame data to be substantially displayed on the display panel 150 is calculated. In order to calculate the display area, edge detection may be performed on the frame data. However, this embodiment is not limed to implementing edge detection.

Then, an output cutoff signal (e.g., SKIP of FIG. 5 or ON/OFF of FIG. 7) is generated to cut off data signals not corresponding to the display area from being output (S130). In generating the output cutoff signal, an output cutoff signal (e.g., SKIP or ON/OFF) is generated to control the data driver 140 to cut off data signals from being output with respect to a portion not corresponding to the display area.

Next, the data signals and the output cutoff signal are output (S140). The data signals and the output cutoff signal (e.g., SKIP or ON/OFF) are supplied to the data driver 140. Thus, the data signals for the portion corresponding to the display area of the display panel 150 are normally output, while the data signals for a portion not corresponding to the display area are cut off from being output.

As a result, for a given scan line, the data driver 140 may have an output channel normally outputting a data signal and another output channel cutting off and not outputting a data signal. In this case, the amplifiers and any other elements in the data driver 140 for amplifying the data signals and outputting the amplified data signals may be skipped or turned off (or not used) for those output channels not corresponding to the display area. Thus, power consumption may be reduced.

As described above, in the example embodiments of the present invention, unnecessary data signals corresponding to a portion of the input image not to be substantially displayed on the display panel are cut off from being output by being skipped (floated) or turned OFF (blanked). Thus, power consumption by the data driver may be reduced, and the overall power consumption by the display device may be reduced. Also, when a quick cover of a smartphone is used, for example, data signals for an area outside a window area shown to a user are cut off from being output. Thus, the power consumption in a window mode may be reduced. Also, the above embodiments of the present invention may be applied generally to display devices by dynamically controlling a portion of the source amplifier to be skipped (floated) or turned off (blanked) to reduce a display area in a power saving mode to provide for further reduction in power consumption.

It will be apparent to those skilled in the art that various modifications and variations can be made in the display device and the method of driving the same of the present invention, and the disclosed embodiments of the invention without departing from the spirit or scope of the invention. Thus, it is intended that the present invention cover the modifications and variations of this invention provided they come within the scope of the appended claims and their equivalents.

What is claimed is:

1. A display device, comprising:

a display panel having a plurality of data lines and a display area configured to display a first portion of an input image;

a source amplifier having a plurality of amplifiers, and configured to receive a first data signal corresponding to the first portion of the input image and a second data signal corresponding to a second portion of the input image outside the display area, to amplify and output the first data signal, and to cut off the second data signal from being amplified and output; and a source amplifier control circuit configured to control the source amplifier to output the amplified first data signal and to cut off the second data signal from being amplified and output, wherein the display panel is configured to display the first portion of the input image based on the amplified first data signal.

2. The display device of claim 1, wherein the source amplifier control circuit is configured to control the source amplifier to float or turn off one of the amplifiers receiving the second data signal and to activate another one of the amplifiers receiving the first data signal to amplify the first data signal.

3. The display device of claim 2, wherein the amplifiers are divided into a plurality of groups, each group having one or more amplifiers, and wherein the source amplifier control circuit is configured to control the amplifiers on a group by group basis so that the one or more amplifiers in a group are activated or turned off together.

4. The display device of claim 1, wherein the source amplifier further includes:

an output terminal configured to output either the amplified first data signal or a blank signal for a corresponding one of the data lines;

an output OFF switch having a switch electrode connected to the source amplifier control circuit, a first electrode connected to a low supply voltage terminal, and a second electrode connected to the output terminal; and an output ON switch having a switch electrode connected to the source amplifier control circuit, a first electrode connected to an output of a corresponding one of the amplifiers, and a second electrode connected to the output terminal, wherein when the corresponding one of the amplifiers receives the first data signal, the source amplifier control circuit activates the output ON switch to supply the amplified first data signal to the output terminal, and when the corresponding one of the amplifiers receives the second data signal, the source amplifier control circuit activates the output OFF switch to supply the low supply voltage representing the blank signal to the output terminal.

5. A display device, comprising:

a data driver configured to receive a first input data signal corresponding to a first portion of an input image and a second input data signal corresponding to a second portion of the input image, to output a first output data signal based on the first input data signal corresponding to the first portion of the input image to be displayed, and to cut off the second input data signal from being processed into an output data signal corresponding to the second portion of the input image; and a display panel having a plurality of data lines and a display area configured to display the first portion of the input image based on the first output data signal from the data driver, wherein the second portion of the input image is substantially outside the display area of the display panel.

6. The display device of claim 5, further comprising:

a display area control circuit configured to analyze the input image to calculate the first portion of the input image to be displayed on the display panel, and to supply to the data driver an output cutoff signal based on the calculation of the first portion of the input image for cutting off the second input data signal corresponding to the second portion of the input image from being processed into an output data signal to the display panel.

7. The display device of claim 6, wherein the data driver comprises:

a source amplifier including a plurality of amplifiers, and configured to receive a first data signal based on the first input data signal and a second data signal based on the second input data signal, to amplify and output the first data signal as the first output signal, and to cut off the second data signal from being amplified and output; and a source amplifier control circuit configured to control the source amplifier to output the amplified first data signal as the first output data signal and to cut off the second data signal from being amplified and output based on the output cutoff signal.

8. The display device of claim 7, wherein the source amplifier control circuit is configured to control the source amplifier to float or turn off one of the amplifiers receiving the second data signal based on the output cutoff signal and to activate another one of the amplifiers receiving the first data signal to amplify the first data signal.

9. The display device of claim 8, wherein the amplifiers are divided into a plurality of groups, each group having one or more amplifiers, and wherein the source amplifier control circuit is configured to control the amplifiers on a group by group basis so that the one or more amplifiers in a group are activated or turned off together.

10. The display device of claim 7, wherein the source amplifier further includes:

an output terminal configured to output either the amplified first data signal or a blank signal for a corresponding one of the data lines;

an output OFF switch having a switch electrode connected to the source amplifier control circuit, a first electrode connected to a low supply voltage terminal, and a second electrode connected to the output terminal; and an output ON switch having a switch electrode connected to the source amplifier control circuit, a first electrode connected to an output of a corresponding one of the amplifiers, and a second electrode connected to the output terminal, wherein when the corresponding one of the amplifiers receives the first data signal, the source amplifier control circuit activates the output ON switch to supply the amplified first data signal to the output terminal, and when the corresponding one of the amplifiers receives the second data signal, the source amplifier control circuit activates the output OFF switch based on the output cutoff signal to supply the low supply voltage representing the blank signal to the output terminal.

11. The display device of claim 5, further comprising:

a memory configured to store a frame data representing a frame of the input image; and a timing controller configured to receive the frame data, and to output the first and second input data signals corresponding to the frame data and timing control signals to the data driver.

12. The display device of claim 6, wherein the data driver comprises:

a digital to analog conversion circuit configured to receive the output cutoff signal, a first digital data signal corresponding to the first input data signal, and a second digital data signal corresponding to the second input data signal, to covert the first digital data signal to a first data signal, to output the first data signal, and to cut off the second digital data signal from being converted and output, wherein in the first data signal is in a form of an analog voltage.

13. The display device of claim 5, wherein the display area has a circular or oval shape.

14. The display device of claim 5, wherein the display panel has a display screen larger than the display area, and the display area is a window area in the display screen, wherein the display panel is configured to display the input image substantially only in the window area in a first mode and to display the input image on substantially the entire display screen in a second mode.

15. The display device of claim 14, wherein the first mode is a power saving mode, and the second mode is a normal operating mode.

16. The display device of claim 14, wherein the display panel is partially covered by a cover exposing the window area in the first mode, and wherein substantially the entire display screen is uncovered in the second mode.

17. The display device of claim 5, wherein the display area has an irregular shape.

18. A method of driving a display device having a display panel, the method comprising:

receiving and analyzing input data signals corresponding to an input image;

calculating a display area in the input image to be displayed on the display panel based on the input data signals, the input data signals having a first input data signal corresponding to a first portion of the input image within the display area and a second input data signal corresponding to a second portion of the input image outside the display area;

generating an output cutoff signal based on the input data signals;

outputting a first output data signal to the display panel based on the first input data signal to display the first portion of the input image on the display panel; and cutting off the second input data signal based on the output cutoff signal from being processed into an output data signal to the display panel.

19. The display device of claim 1, wherein the display panel is further configured to display the first portion of the input image based on the amplified first data signal without displaying the second portion of the input image.

20. The display device of claim 5, wherein the display panel is further configured to display the first portion of the input image based on the first output data signal without displaying the second portion of the input image.

* * * * *